US006419274B1

(12) United States Patent
Geddes

(10) Patent No.: US 6,419,274 B1
(45) Date of Patent: Jul. 16, 2002

(54) BOOK COVERING

(75) Inventor: James Geddes, Westoning (GB)

(73) Assignee: Book Protectors & Co., London (GB)

( * ) Notice: Subject to any disclaimer, the term of this patent is extended or adjusted under 35 U.S.C. 154(b) by 0 days.

(21) Appl. No.: 09/676,903

(22) Filed: Oct. 2, 2000

(30) Foreign Application Priority Data

Jul. 4, 2000 (GB) ..... 0016463

(51) Int. Cl.[7] ..... B42D 1/00
(52) U.S. Cl. ..... 281/19.1; 281/17; 281/34
(58) Field of Search ..... 281/19.1, 17, 16, 281/22, 29, 34, 35, 51, 15.1; 402/70, 73

(56) References Cited

U.S. PATENT DOCUMENTS 3,946,867 A * 3/1976 McGuire et al. ..... 281/19.1
4,139,216 A * 2/1979 Saint Clair ..... 281/19.1 X
4,527,814 A * 7/1985 Carter ..... 281/19.1 X
5,472,237 A * 12/1995 Rajeswaran ..... 281/19.1 X

FOREIGN PATENT DOCUMENTS

| | | |
|---|---|---|
| GB | 222297 | 10/1924 |
| GB | 445122 | 4/1936 |
| GB | 913952 | 12/1962 |

OTHER PUBLICATIONS

Search Report under Section 17 of Patents Act 1977; The Patent Office; United Kingdom.

* cited by examiner

*Primary Examiner*—William Fridie, Jr.
(74) *Attorney, Agent, or Firm*—Wallenstein & Wagner, Ltd.

(57) ABSTRACT

A book covering, for example for protecting a dust jacket on a hardback book, has a transparent front sheet (10) and overlapping upper and lower rear sheets (12,14) which can be secured together by means of an adhesive strip (26). In an alternative embodiment, one of the rear sheets may be omitted and the adhesive (26) applied to the upper edge of the transparent front sheet (10). That sheet may then be folded over by the required amount, according to the size of book to be covered, and secured to the rear sheet (14).

11 Claims, 2 Drawing Sheets

BOOK COVERING

TECHNICAL FIELD

The present invention relates to book coverings and in particular although not exclusively to book coverings for protecting the dust jackets of hardback books.

BACKGROUND OF THE INVENTION

One popular existing design for protecting the dust jackets of hardback books consists of a front sheet of a transparent plastics material along with a rear sheet of stiff paper. The front and rear sheets are secured together along their respective upper and lower edges to form an elongate sleeve which is open at each end. To use the sleeve, the dust jacket is slid into one of the open ends, so that the dust jacket design can be seen through the front transparent sheet. The sleeve is then cut to length and is wrapped around the hard covers of a book. To secure the sleeve in place, the leading edges of the front and rear covers are pushed into the open ends of the sleeve.

Although such book coverings have proved extremely popular in practice, they do in use require a certain amount of time and care to be taken. The amount of time taken to cover a single book can be of importance, particularly for library users who may wish to cover hundreds of books.

In addition, each sleeve is of a fixed height, which means that stock in several sizes must be produced in order to deal with the variety of different book heights that might be met with in practice.

SUMMARY OF THE INVENTION

It is an object present invention to reduce the time necessary to apply a covering to a book. It is a further object, in at least some embodiments of the invention, to provide a design which can be used with a wider range of book heights.

According to the present invention there is provided a book covering comprising an elongate sleeve having an opening along its length defined by first and second sheet edges, the edges being adapted to overlap to close the opening and one of the sheet edges carrying an adhesive for retaining the edges in an overlapped position.

It is to be understood of course that the adhesive may be applied to the sheet right up to the edge or, alternatively, merely adjacent to the edge. The adhesive preferably forms a continuous strip extending along or parallel to the edge, but a series of individual areas or spots of adhesive could also be used. The adhesive is preferably protected by a release strip, for example of waxed or wax-like paper.

The sleeve may comprise a front sheet and upper and lower overlapping rear sheets, with the opening being defined by a lower distal edge of the upper sheet and an upper distal edge of the lower sheet. In this arrangement, the lower sheet preferably overlies the upper sheet, with the adhesive being provided either on the rearward facing surface of the upper sheet or alternatively the forward-facing surface of the lower sheet. It will be understood that the expressions "upper" and "lower" will be reversed if the covering is turned upside down, there being no intrinsic "upward" or "downward" direction for the product. The upper sheet may overlie the lower, when they are in the overlapped position, with the adhesive in such an arrangement being provided either on the forward-facing surface of the upper sheet or the rearward-facing surface of the lower.

The upper rear sheet may be secured to the front sheet along their common upper edges, and the lower rear sheet may likewise be secured to the front sheet along their common lower edges. This may be achieved by means of an adhesive or any other convenient securing means. This could for example be high-frequency welding, if both the front and the rear sheets were of a plastics material. Preferably, however, the front sheet is of a plastics material, for example PVC, and the rear sheets are of stiff paper or card.

In one variant, both the front and rear sheets could be integral one with another.

In one embodiment, the sleeve may comprise a front sheet and a rear sheet, with the opening being defined by an upper edge of the first sheet and an upper edge of the rear sheet. Once again, of course, the expression "upper" may include "lower" if the covering were to be turned upside down.

The first and second edges may be adapted to overlap when the front sheet is folded back along a fold-line which may extend the length of the sleeve. Preferably, the position of this fold-line is not pre-defined during manufacture, but is simply chosen by a user according to the height of a book which is desired to be covered. Alternatively, the fold-line could be predefined and could for example be pre-folded during manufacture.

In the preferred form of this embodiment, the adhesive is carried on the upper edge of the front sheet. When the front sheet is folded over, it then overlies the upper edge of the rear sheet. It would also be possible given such an arrangement of sheets for the adhesive to be supplied instead on the rearward-facing surface of the rear sheet.

Yet a further possibility would be for the rear sheet to overlie the turned back front sheet. With such an arrangement, the adhesive could be supplied either on the forward-facing surface of the rear sheet or alternatively on the rearward-facing surface of the front sheet (in its folded back position).

The rear sheet may be secured to the front sheet along their common lower edges, for example by means of an adhesive or (depending upon the sheet materials) by high-frequency welding. Alternatively, the front sheet may be integral with the rear sheet.

The invention extends to a book when covered with a book covering as previously defined.

The invention further extends to a method of covering a book and/or a method of protecting a book dust jacket.

BRIEF DESCRIPTION OF THE DRAWINGS

The invention may be carried into practice in a number of ways and two specific embodiments will now be described, by way of example, with reference to the accompanying drawings, in which.

DETAILED DESCRIPTION OF THE PREFERRED

Figure 1:
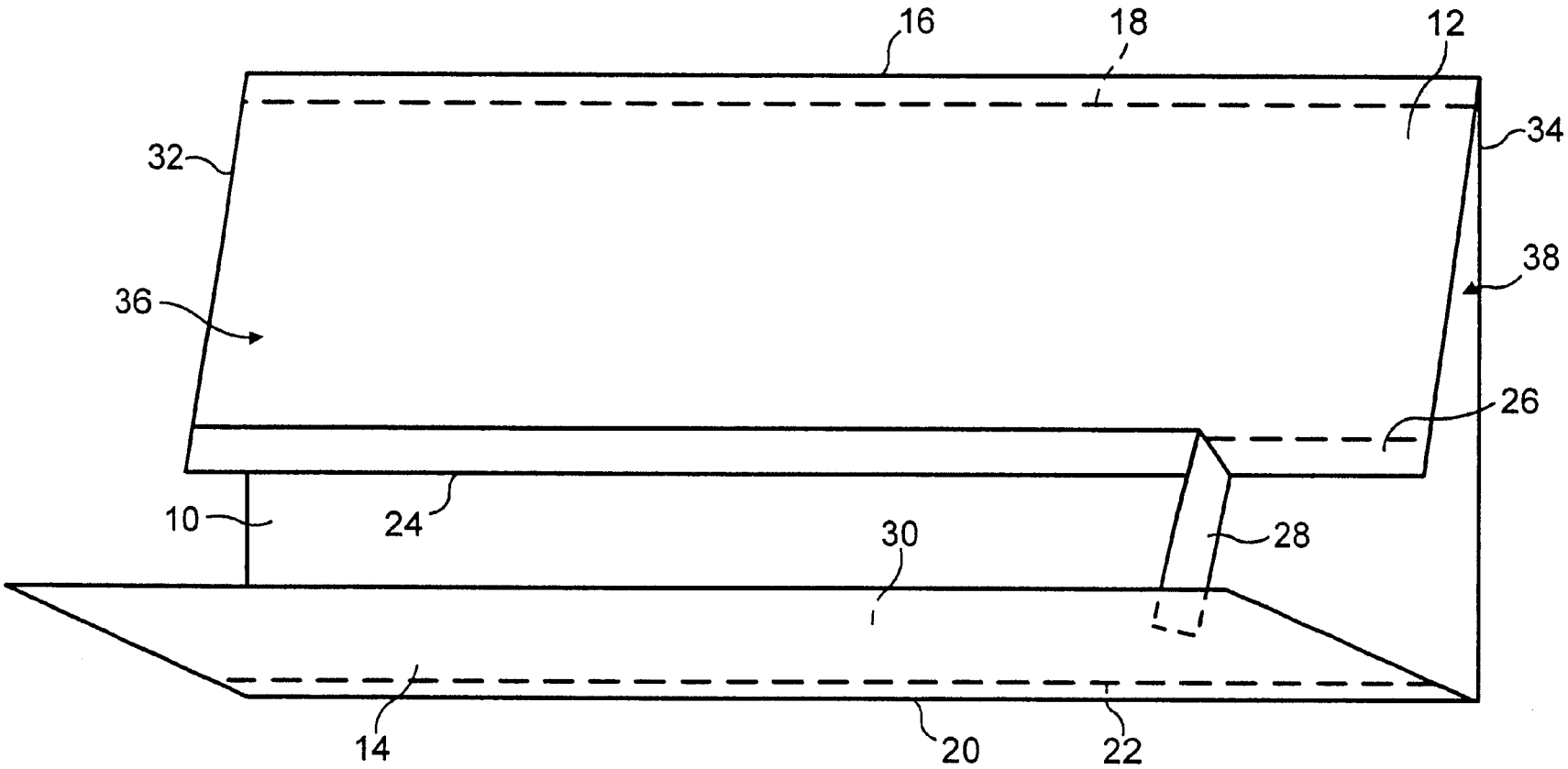
FIG. 1 is a first embodiment of a book covering according to a first embodiment of the present invention.

The book covering shown in FIG. 1 consists of a front clear plastics sheet (eg of PVC), and two rear sheets (eg of stiff paper) 12,14. The upper rear sheet 12 is secured to the front sheet 10 along their respective upper edges 16. The attachment could be carried out in any convenient manner, but in the preferred embodiment the front sheet 10 folded over along its upper edge so that it overlays the rear sheet 12, as shown at 18. The two surfaces are then secured by adhesive.

Likewise, the rear sheet 14 is secured to the front sheet 10 along their respective lower edges 20. Once again, this could be carried out in any convenient manner, but in the preferred embodiment the front sheet 10 is folded over as shown at 22 and secured to the rear sheet by adhesive.

In a less-desired variant (not shown) the rear sheets 12,14 could be integral with the front sheet 10 and all could, for example, be of a transparent plastics material such as PVC.

Along the lower edge 24 of the upper sheet 12 is a strip of adhesive 26, protected by a removable release strip 28.

The upper and lower sheets are sized so that they slightly overlap. When the release strip 28 is removed the lower sheet 14 can be flattened down against the upper sheet, with the adhesive 26 then securing the rear surface of the upper sheet to the front surface 30 of the lower sheet The book covering shown in FIG. 1 is used in the following way. First, the upper and lower sheets are turned back and the dust jacket to be protected is placed onto the rear surface of the transparent sheet 10, with the design facing forwardly so that it can be seen through the transparent sheet. The sleeve is then closed, and the release strip 28 removed to expose the adhesive. The upper and lower sheets are then stuck together, and the resultant sleeve cut to length, according to the length of the dust cover that is being protected.

The enclosed sleeve is then applied to the hardback book. This is done by placing the open book cover side down on the rear surface of the sleeve, and folding up the sleeve ends 32,34. The leading edges of the book covers are then inserted into the open ends 36,38 of the sleeve, behind the dust jacket. The covering holds itself in place on the book, without the needs for adhesive tape or any other fixing.

To make it easier to insert the leading edges of the book covers into the openings 36,38, the user may find it convenient not fully to stick down the ends of the sheet 14 onto the adhesive strip 26.

Figure 2:
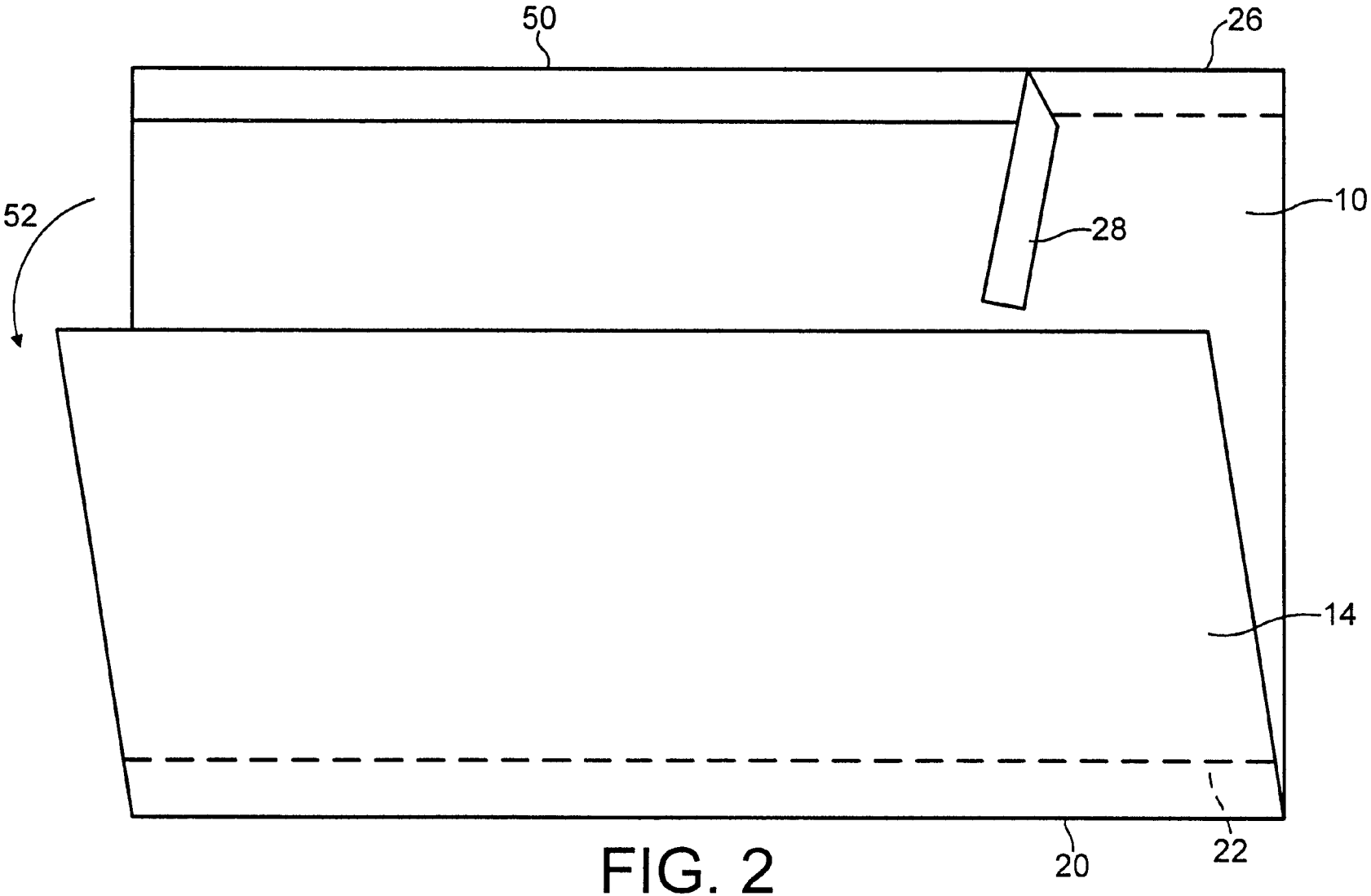
FIG. 2 shows a book covering according to a second embodiment of the invention.

A second embodiment of the present invention is shown in FIG. 2. For convenience, the same reference numerals are used for similar parts.

This embodiment differs from the embodiment of FIG. 1 in that the upper rear sheet 12 is omitted. Instead, the adhesive 26 and release strip 28 are provided along an upper edge 50 of the front sheet 10. In use, the dust jacket is placed between the front sheet 10 and the rear sheet 14, and the upper edge 50 is then turned down over the upper edge of the dust jacket as shown by the arrow 52. The release strip is removed, and the adhesive 26 secured onto the rear surface of the sheet 14. The resultant sleeve is then attached to the book as described above.

The embodiment of FIG. 2 is inexpensive to manufacture and has the further advantage that the dust jacket to be protected may be positioned extremely quickly and easily. The user decides exactly how far down to fold the front sheet, depending upon the dust jacket height. The fact that the covering may be used for a range of different book heights reduces both manufacturing and stock costs.

What is claimed is:

1. A book covering comprising:

an elongated sleeve formed by two rear sheets and a front sheet disposed therebetween and defining common edges between each rear sheet and the front sheet, each rear sheet secured to the front sheet either at or adjacent their common edges and each rear sheet having a distal edge with an opening being formed between overlapping distal edges; and, an adhesive carried by the distal edge of at least one of the rear sheets to retain the overlapping distal edges to one another and to close the opening.

2. A book covering comprising:

an elongated sleeve formed by a rear sheet and a front sheet, both sheets being secured either at or adjacent a common edge and having a distal edge with an opening formed between overlapping distal edges; and, an adhesive carried by the distal edge of at least one of the sheets to retain the overlapping distal edges to one another and to close the opening.

3. A book covering as claimed in claim 1 in which the adhesive forms a strip either along the edge carrying the adhesive or adjacent to the edge carrying the adhesive.

4. A book covering as claimed in claim 3 in which the adhesive is protected by a release strip.

5. A book covering as claimed in claim 1 in which the front sheet and the respective rear sheets are secured together by an adhesive.

6. A book covering as claimed in claim 1 in which the front sheet and the rear sheets are integral with one another.

7. A book covering as claimed in claim 2 in which the first and second edges overlap when the front sheet is folded back along a fold line extending the length of the sleeve.

8. A book covering as claimed in claim 7 in which the book to be covered has a height and, in use, the position of the fold line is chosen according to the height of the book to be covered.

9. A book covering as claimed in claim 2 in which the adhesive is carried on the upper edge of the front sheet.

10. A book covering as claimed in claim 2 in which the front sheet and the rear sheet are secured together by an adhesive.

11. A book covering as claimed in claim 2 which the front sheet IS integral with the rear sheet.

* * * * *